US008974016B2

(12) United States Patent
Costin, Sr. et al.

(10) Patent No.: US 8,974,016 B2
(45) Date of Patent: Mar. 10, 2015

(54) SURFACE MARKED ARTICLES, RELATED METHODS AND SYSTEMS

(71) Applicant: Masonite Corporation, Tampa, FL (US)

(72) Inventors: Darryl J. Costin, Sr., Westlake, OH (US); Darryl J. Costin, Jr., Avon, OH (US); Scott Fellin, Geneva, IL (US); Chase Carter, Joliet, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 14/452,104

(22) Filed: Aug. 5, 2014

(65) Prior Publication Data

US 2015/0030821 A1 Jan. 29, 2015

Related U.S. Application Data

(63) Continuation of application No. 13/800,542, filed on Mar. 13, 2013, now Pat. No. 8,794,724.

(60) Provisional application No. 61/616,670, filed on Mar. 28, 2012.

(51) Int. Cl.

| | |
|---|---|
| ***B41J 3/00*** | (2006.01) |
| ***B41J 2/01*** | (2006.01) |
| ***B41J 3/54*** | (2006.01) |
| ***B41J 3/42*** | (2006.01) |

(52) U.S. Cl.

CPC .. *B41J 2/01* (2013.01); *B41J 3/546* (2013.01); *B41J 3/42* (2013.01)

USPC ..... 347/2; 347/5; 347/9

(58) Field of Classification Search

CPC ..... B41J 3/546; B41J 3/42; B41J 3/54; B41J 3/60; B41J 3/543; B41J 2/17503; B41J 2/2103; B41J 2/01

USPC ..... 347/2, 5, 9

See application file for complete search history.

(56) References Cited

U.S. PATENT DOCUMENTS

| | | | |
|---|---|---|---|
| 3,720,784 | A | 3/1973 | Maydan et al. |
| 3,761,675 | A | 9/1973 | Mason et al. |
| 3,789,421 | A | 1/1974 | Chivian et al. |
| 4,024,545 | A | 5/1977 | Dowling et al. |

(Continued)

FOREIGN PATENT DOCUMENTS

| | | | |
|---|---|---|---|
| DE | 3916126 | A1 | 11/1990 |
| GB | 2294656 | A | 5/1996 |

(Continued)

OTHER PUBLICATIONS

WeldHelp: Expulsion/Burn Through; http://www.romanmfg.com/weldhelp/issues/expuls.htm, 3 pages.

(Continued)

*Primary Examiner* — Juanita D Jackson

(74) *Attorney, Agent, or Firm* — Berenato & White, LLC

(57) ABSTRACT

A method of surface marking an article, especially a building product, is provided. One described method includes the steps of laser marking a first graphic design element on a surface of an article and ink-jet printing a second graphic design element in registry with the first graphic design element on the surface of the article to create a high quality overall graphic design. Also provided are articles made according to this method, and systems for carrying out the method.

8 Claims, 14 Drawing Sheets

(56) References Cited

U.S. PATENT DOCUMENTS

| | | | | |
|---|---|---|---|---|
| 4,629,858 | A | 12/1986 | Kyle | |
| 4,847,184 | A | 7/1989 | Taniguchi et al. | |
| 4,861,620 | A | 8/1989 | Azuma | |
| 4,947,022 | A | 8/1990 | Ostroff et al. | |
| 5,017,423 | A | 5/1991 | Bossmann et al. | |
| 5,075,195 | A | 12/1991 | Baebler et al. | |
| 5,171,450 | A | 12/1992 | Hoots | |
| 5,171,650 | A | 12/1992 | Ellis et al. | |
| 5,185,511 | A | 2/1993 | Yabu | |
| 5,200,592 | A | 4/1993 | Yabu | |
| 5,567,207 | A | 10/1996 | Lockman et al. | |
| 5,990,444 | A | 11/1999 | Costin | |
| 6,140,602 | A | 10/2000 | Costin | |
| 6,173,211 | B1 | 1/2001 | Williams et al. | |
| 6,231,196 | B1 | 5/2001 | Mahachek | |
| 6,252,196 | B1 | 6/2001 | Costin et al. | |
| 6,315,202 | B2 | 11/2001 | Costin et al. | |
| 6,491,361 | B1 | 12/2002 | Spann | |
| 6,495,237 | B1 * | 12/2002 | Costin | 428/116 |
| 6,576,862 | B1 | 6/2003 | Costin et al. | |
| 6,638,440 | B1 | 10/2003 | Grimard | |
| 6,664,505 | B2 | 12/2003 | Martin | |
| 6,685,868 | B2 * | 2/2004 | Costin | 264/400 |
| 6,753,501 | B1 * | 6/2004 | Costin et al. | 219/121.82 |
| 6,807,456 | B1 | 10/2004 | Costin et al. | |
| 6,819,972 | B1 | 11/2004 | Martin et al. | |
| 6,858,815 | B1 | 2/2005 | Costin | |
| 7,001,016 | B2 | 2/2006 | Baxter et al. | |
| 7,034,248 | B2 | 4/2006 | Crouse, Jr. et al. | |
| 7,438,407 | B2 | 10/2008 | Coghlan et al. | |
| 7,699,896 | B1 | 4/2010 | Colwell | |
| 8,201,333 | B2 | 6/2012 | Wysock et al. | |
| 8,424,264 | B2 | 4/2013 | Coghlan et al. | |
| 2001/0044353 | A1 | 11/2001 | Nosaka et al. | |
| 2003/0020767 | A1 | 1/2003 | Saksa | |
| 2004/0028830 | A1 | 2/2004 | Bauer | |
| 2005/0045594 | A1 | 3/2005 | Crouse et al. | |
| 2005/0155500 | A1 | 7/2005 | Latos et al. | |
| 2005/0213114 | A1 | 9/2005 | Clark et al. | |
| 2006/0281333 | A1 | 12/2006 | Shin et al. | |
| 2007/0108170 | A1 | 5/2007 | Costin et al. | |
| 2007/0129841 | A1 | 6/2007 | Colico et al. | |
| 2007/0221344 | A1 | 9/2007 | Beach et al. | |
| 2007/0251929 | A1 | 11/2007 | Sukhman et al. | |
| 2008/0241478 | A1 | 10/2008 | Costin et al. | |
| 2008/0266300 | A1 | 10/2008 | Deering et al. | |
| 2009/0019801 | A1 | 1/2009 | Coghlan et al. | |
| 2009/0025123 | A1 | 1/2009 | Weedlun et al. | |
| 2009/0266804 | A1 | 10/2009 | Costin et al. | |
| 2010/0043314 | A1 | 2/2010 | Ruggie et al. | |
| 2010/0047536 | A1 | 2/2010 | Del Mundo et al. | |
| 2010/0176101 | A1 | 7/2010 | Costin et al. | |
| 2010/0330336 | A1 | 12/2010 | Guillot et al. | |
| 2011/0049766 | A1 | 3/2011 | Del Mundo et al. | |
| 2012/0258330 | A1 | 10/2012 | Wysock et al. | |

FOREIGN PATENT DOCUMENTS

| | | | |
|---|---|---|---|
| JP | 1-95885 | A | 4/1989 |
| JP | 3-45578 | A | 2/1991 |
| JP | 5-138374 | A | 6/1993 |
| WO | 93/22944 | A1 | 11/1993 |
| WO | 2006/025016 | A1 | 3/2006 |

OTHER PUBLICATIONS

Wikpedia; Laser ablation; http://en.wikipedia.org/wiki/Laser_ablation.

* cited by examiner

SURFACE MARKED ARTICLES, RELATED METHODS AND SYSTEMS

CROSS-REFERENCE TO RELATED APPLICATION

This application is a continuation of Ser. No. 13/800,542, filed Mar. 13, 2013, now U.S. Pat. No. 8,794,724, which claims benefit of U.S. Provisional Application Ser. No. 61/616,670 filed Mar. 28, 2012, which is hereby incorporated herein by reference in its entirety and to which priority is claimed.

FIELD OF THE INVENTION

The present invention relates to articles surface-marked by laser marking and ink-jet printing to provide high quality decorative products. The present invention further relates to methods and systems for making, processing, and using such articles.

BACKGROUND OF THE INVENTION

Residential and commercial building products are often made of an engineered composite material, including cellulosic composite materials such as medium to high density fiberboard and particleboard, as well as other "synthetic" materials such as laminates, veneers, and reinforced polyester sheet molding compounds (SMC), to name a few. Such products find various applications, including interior uses, such as for interior passageway doors and door skins, drywall, countertops, kitchen cabinets, wainscoting, flooring, wall panels, ceiling tiles, interior trim components, and exterior uses, such as for entry doors, decking, siding, trim, fencing, and window frames.

While synthetic materials may provide substantial cost savings over natural materials such as wood, stone, and ceramic, synthetic materials lack the attractive appearance and the authenticity of natural materials. For this reason, extensive efforts have been made to modify the surface appearance of synthetic materials such as engineered composite materials to simulate the beauty and intricacy of natural materials. Conventional printing technologies such as ink-jet printing apply ink graphics to the surface of synthetic materials to mimic the general patterns of a naturally occurring material. Synthetic materials with ink-jet graphics alone, however, may not have sufficient aesthetic appeal to more discriminate consumers.

Ink-jet printed surfaces lack a textural feel inherent in many natural materials, and vital to their appearance. Additionally, cylinder printing and foil overlay techniques suffer from various problems when they are utilized on non-uniform surfaces. Non-uniform article surfaces may have particular features, such as channels or recesses, which lie below a principal planar surface of the article. Cylinder printing techniques may fail to contact such surface features below the principal planar surface. Foil overlays, on the other hand, may completely hide or conceal these features. Other surface decorative processes such as sandblasting and veneering have their drawbacks as well, such as high cost.

SUMMARY OF THE INVENTION

In accordance with an embodiment, a method of surface marking an article comprises laser marking and ink-jet printing. A first graphic design element is laser-marked on a surface of an article with a laser beam having an EDPUT value in the range of approximately 0.12 watts-sec/mm$^3$ and 79.6 watts-sec/mm$^3$. A second graphic design element is ink-jet printed in a predetermined orientation with the first graphic design element on the surface of the article.

Other aspects of the invention, including apparatus, systems, methods, and the like which constitute part of the invention, will become more apparent upon reading the following detailed description of the exemplary embodiments and viewing the drawings.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

Figure 6A:
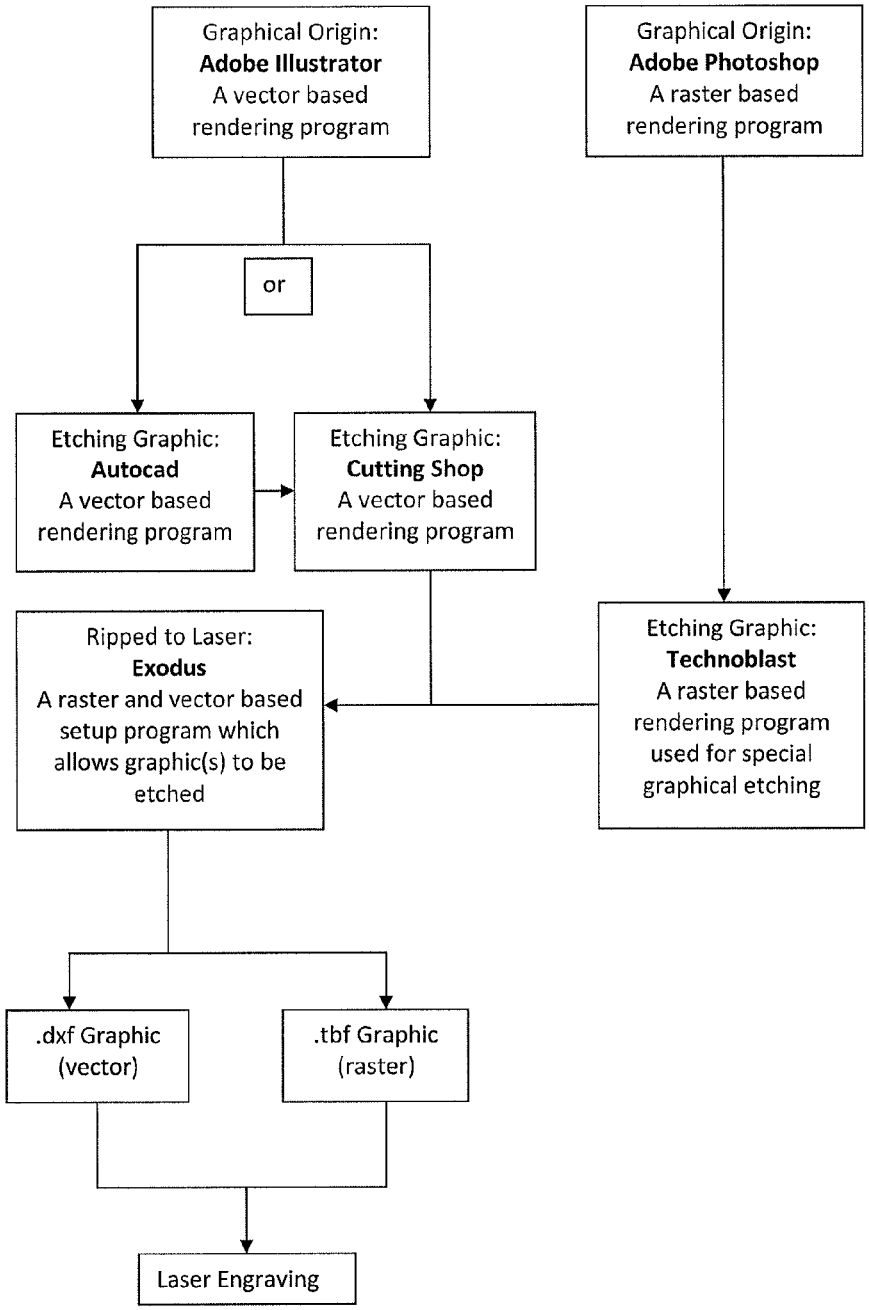
Figure 6B:
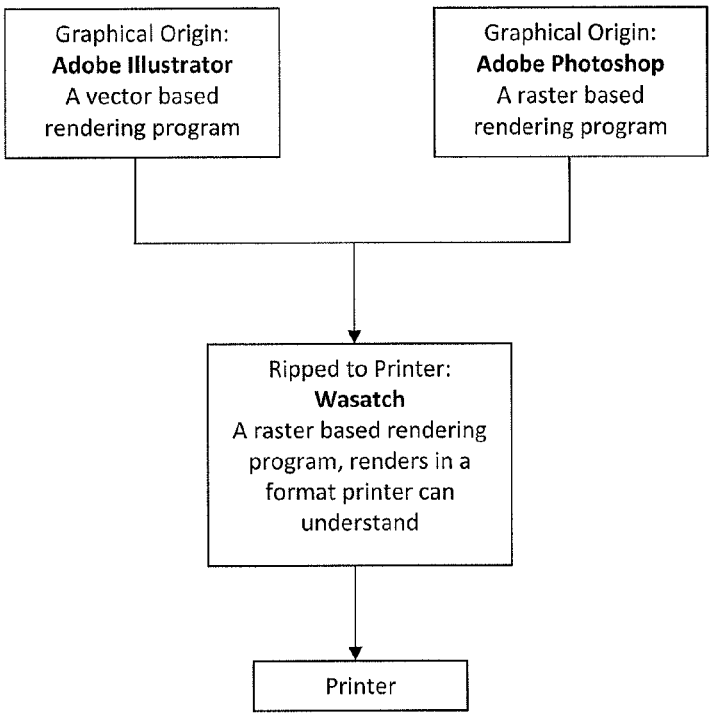
Figure 7:
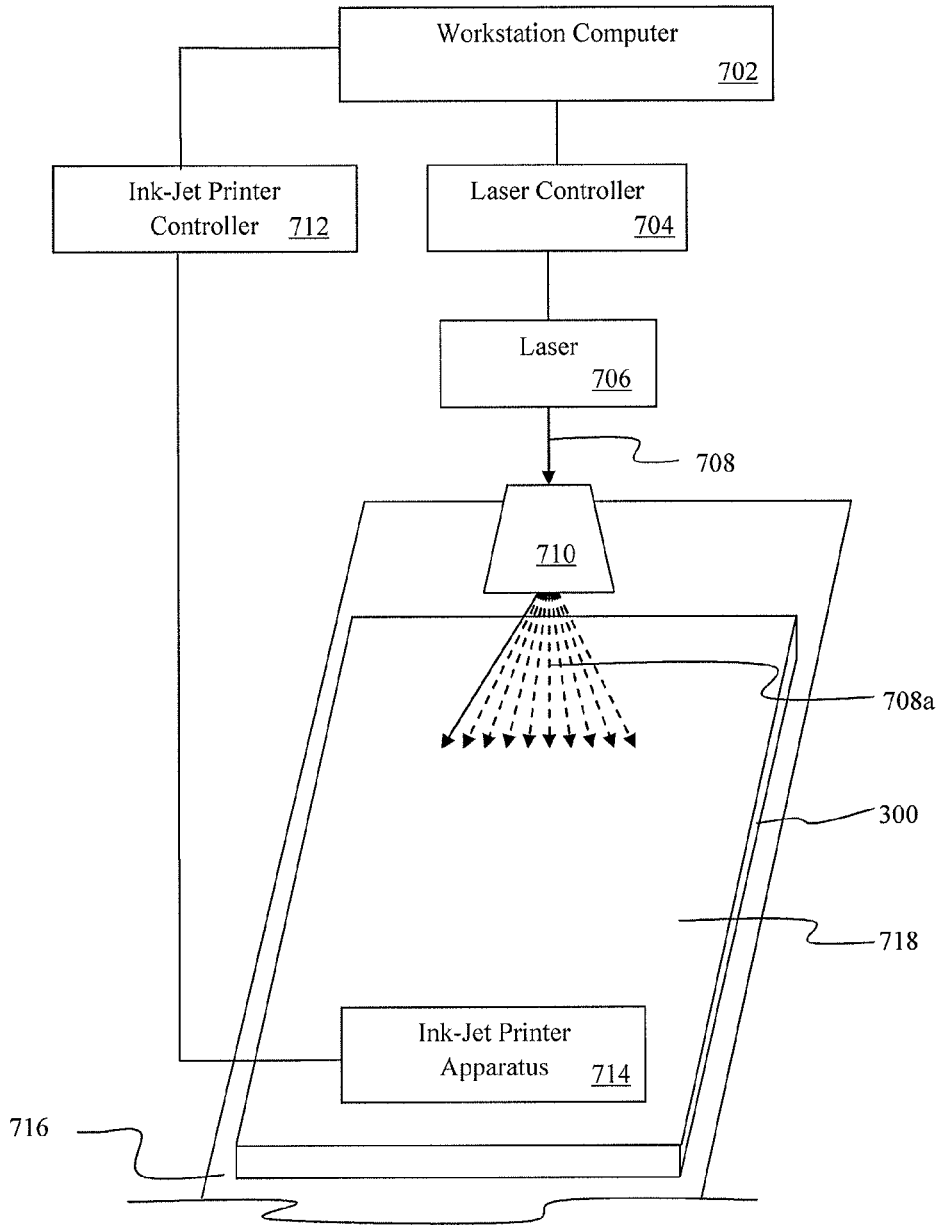
Figure 8:
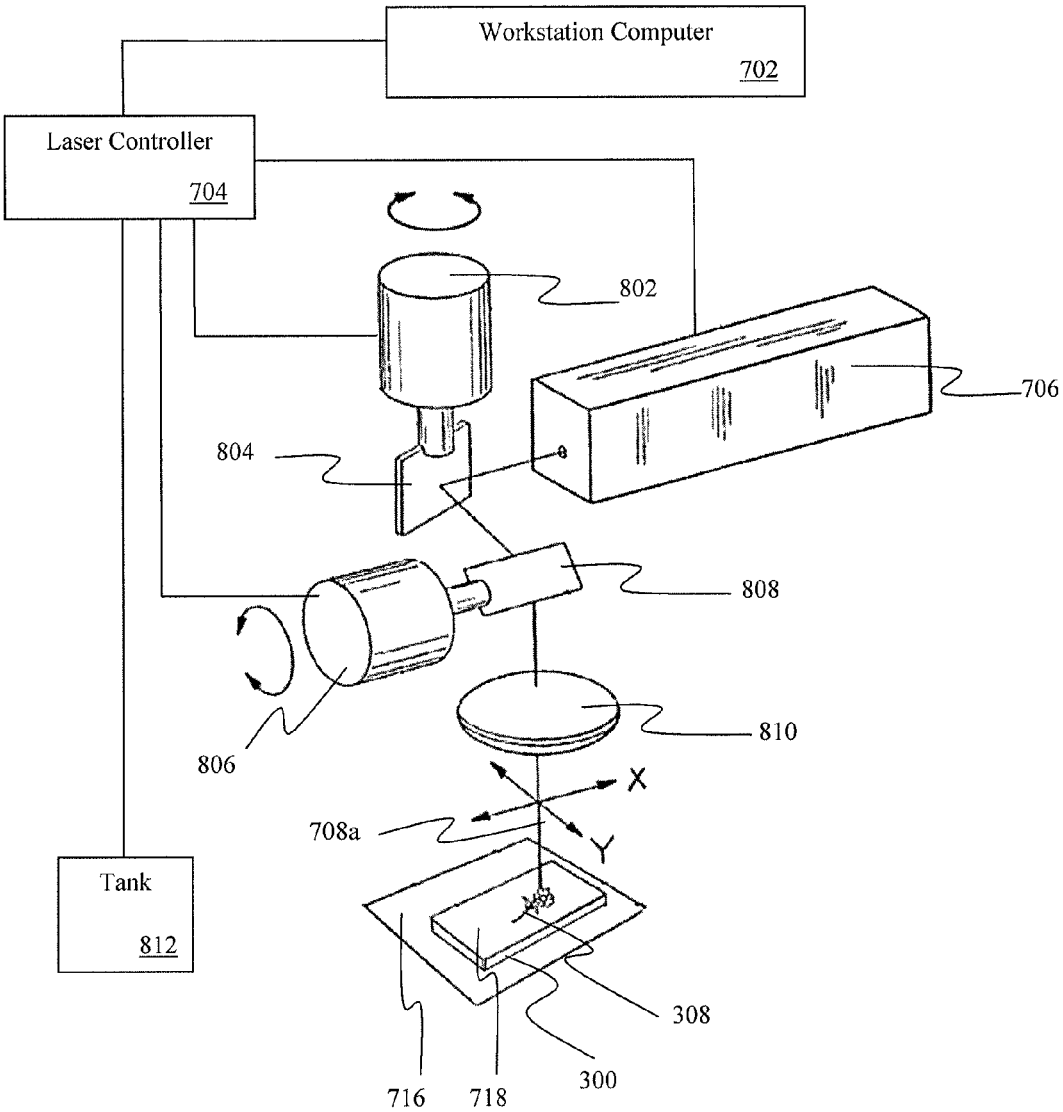
Figure 9:
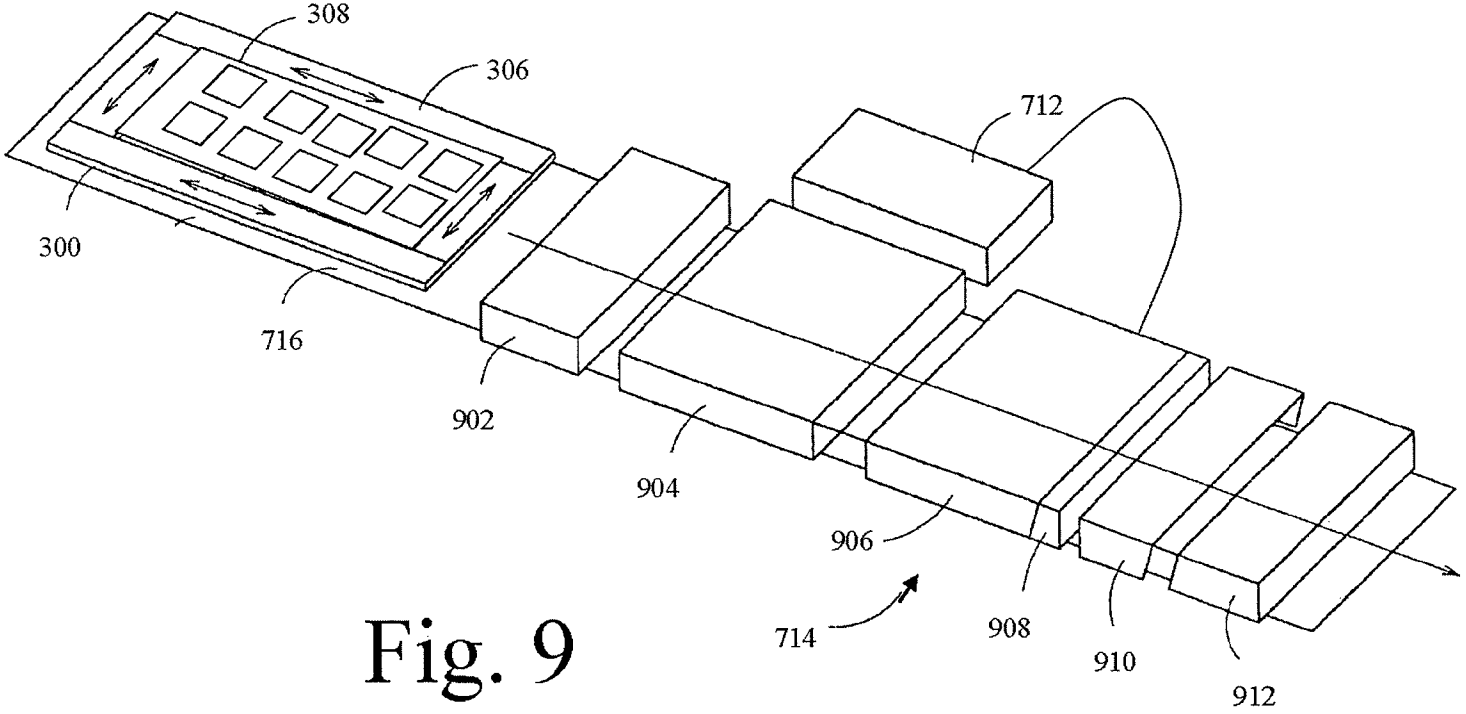
Figure 10:
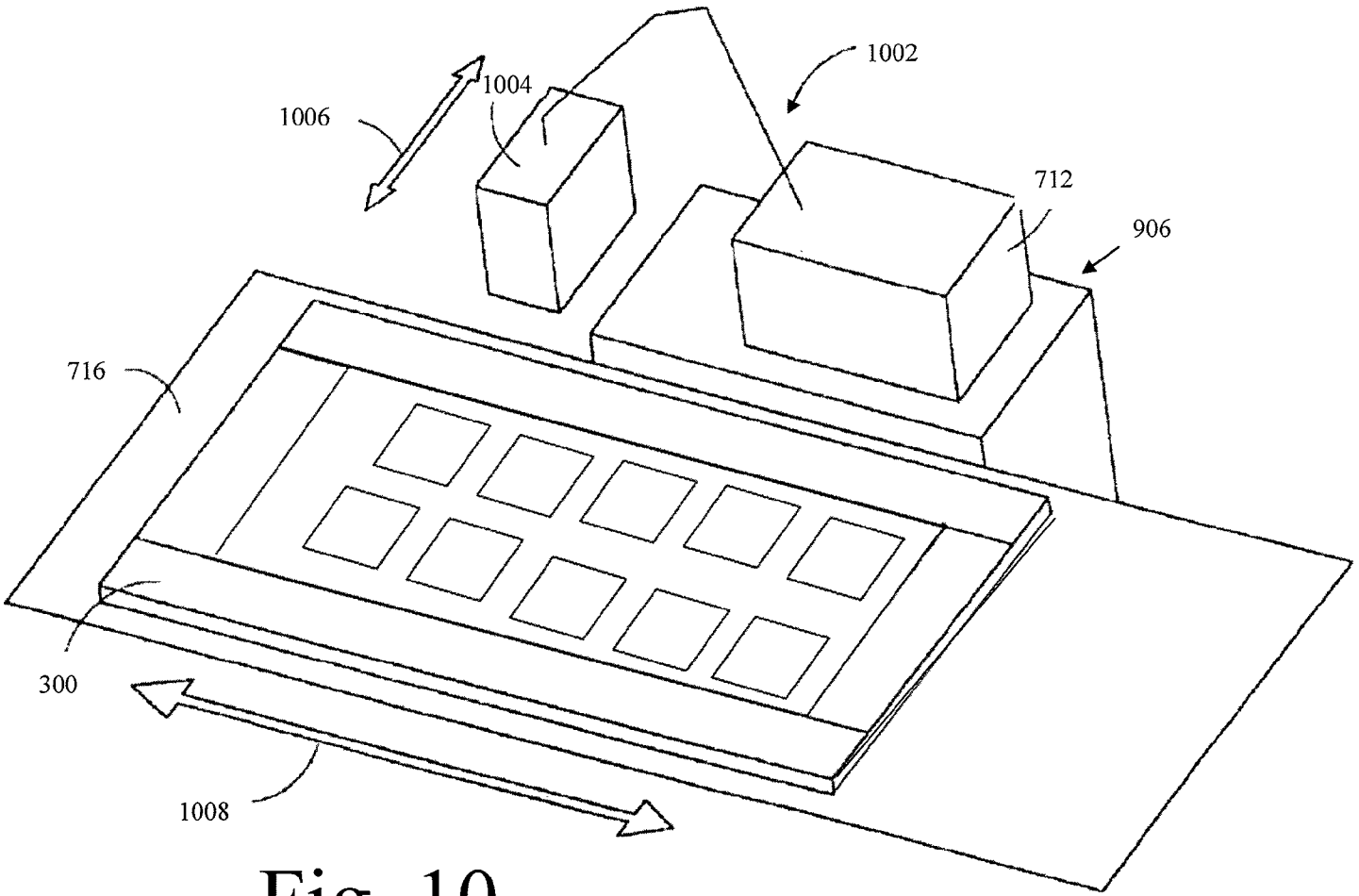
Figure 11:
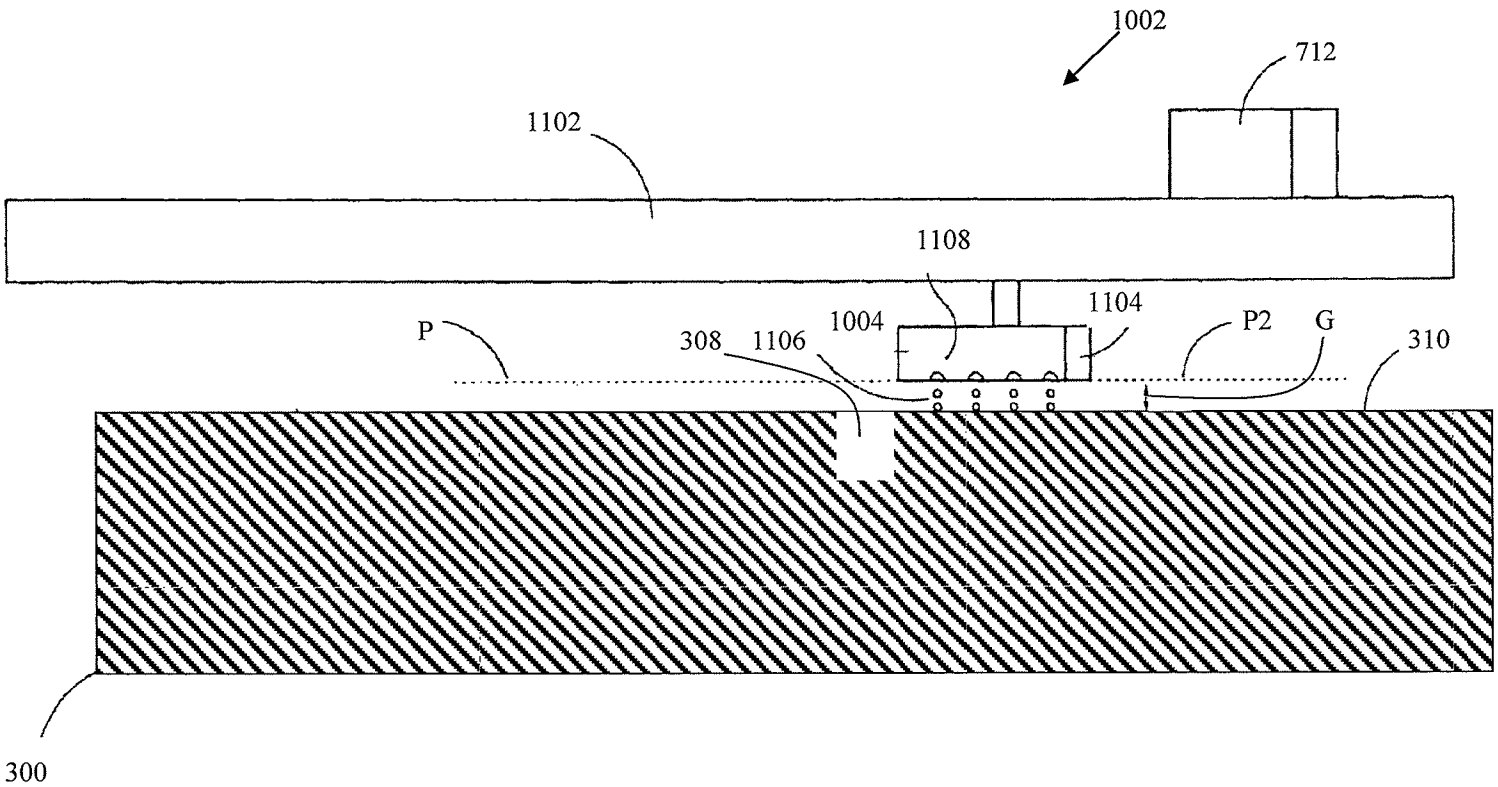
Figure 12:
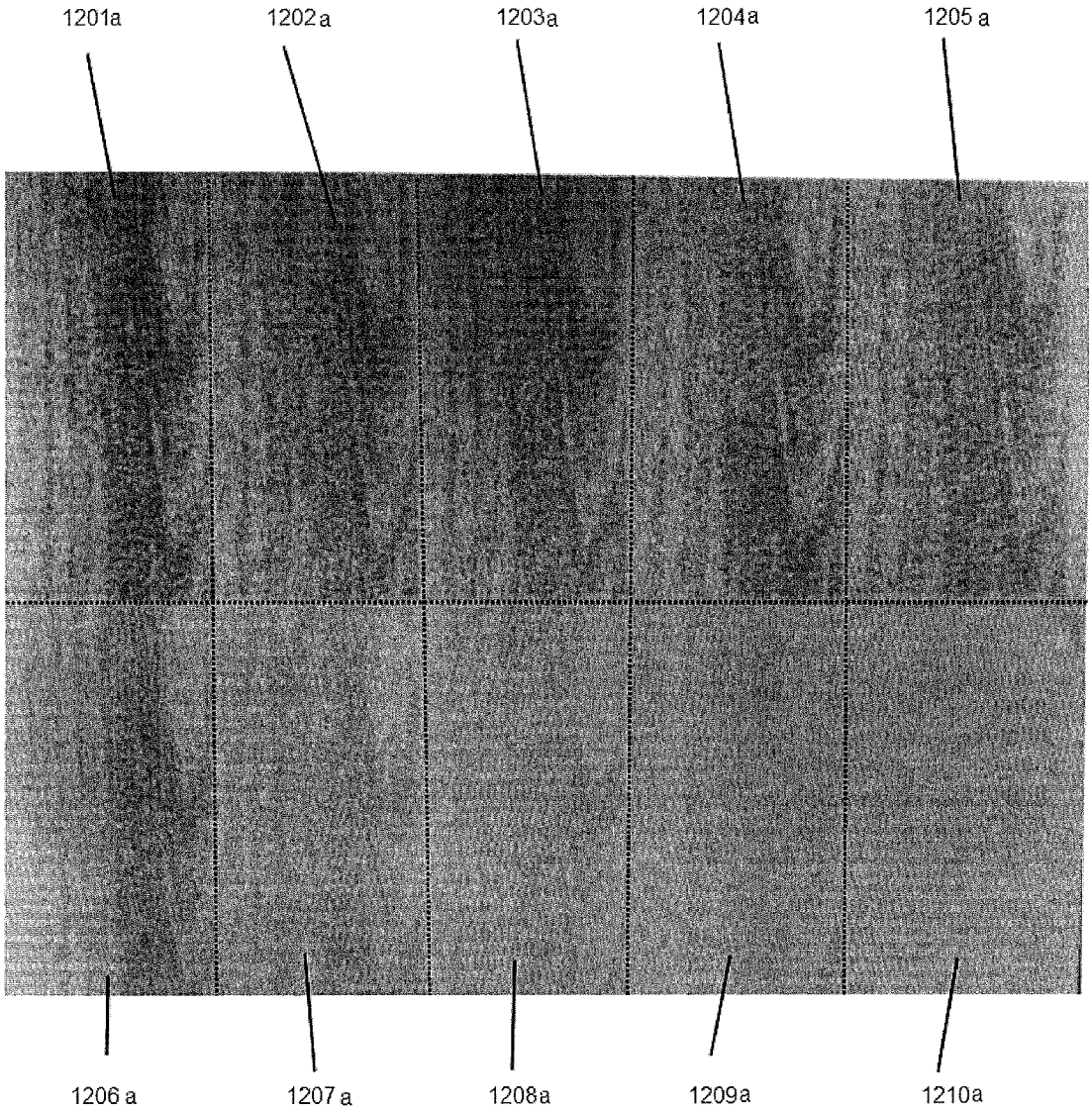
Figure 13:
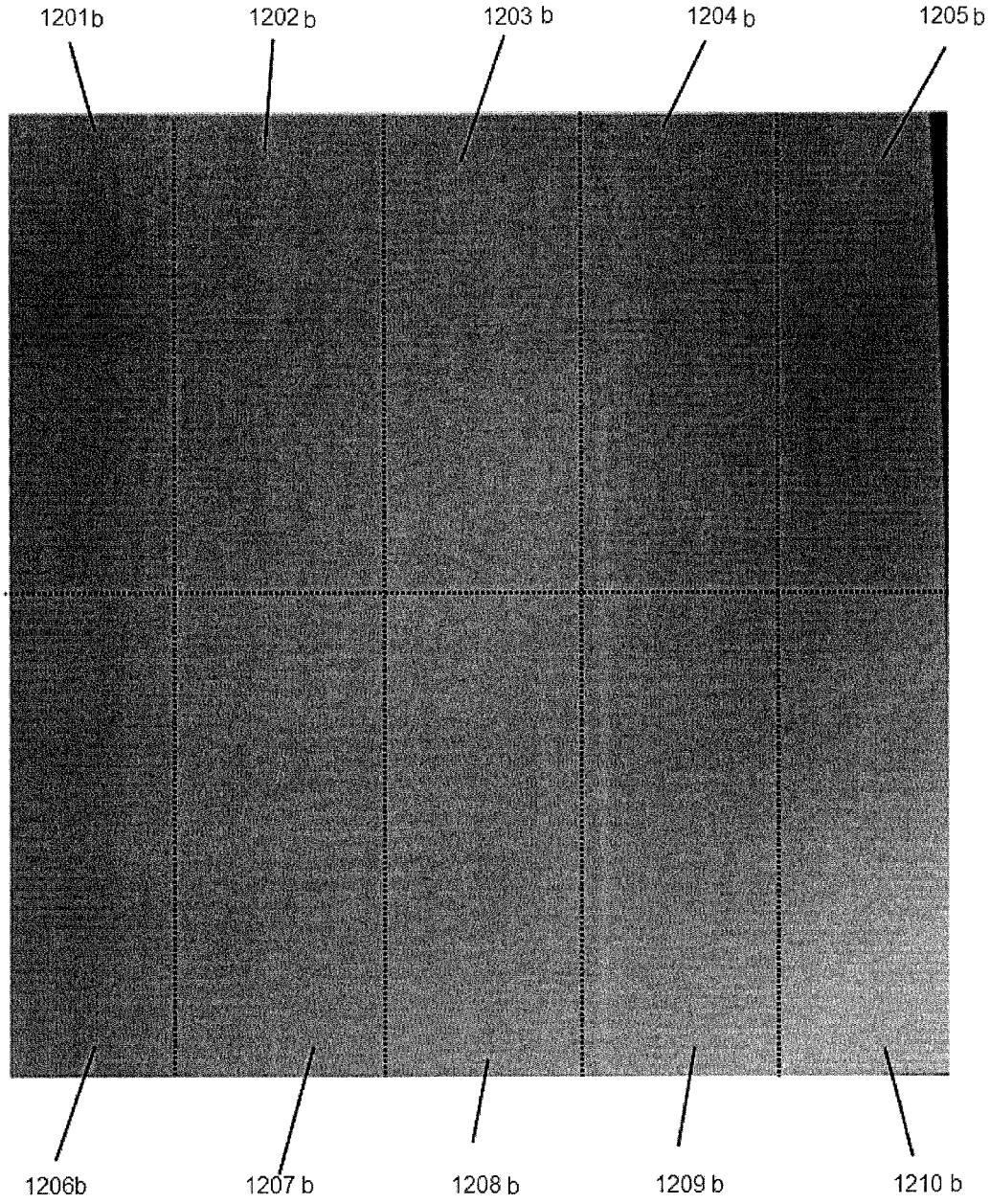
Figure 14:
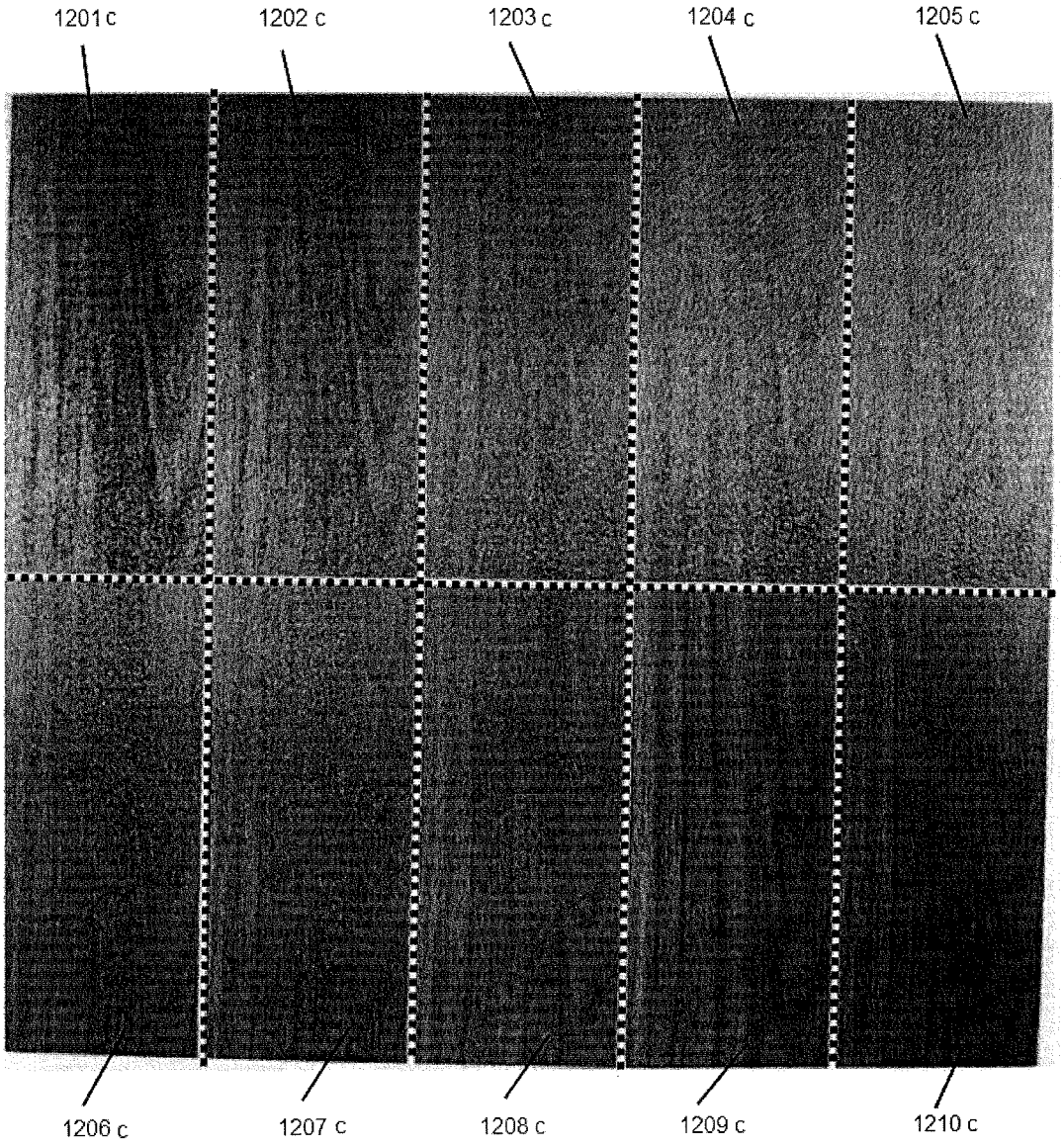

FIG. 6*a* is a flowchart of a method for laser-marking a surface of an article according to another embodiment of the invention;

FIG. 6*b* is a flowchart of a method for ink-jet printing a surface of an article according to another embodiment of the invention;

FIG. 7 is a schematic view of a system for marking a surface of an article according to an embodiment of the invention;

FIG. 8 is a schematic view of a laser controller and laser of the system of FIG. 7 according to an embodiment of the invention;

FIG. 9 is a schematic view of an ink-jet printing apparatus of the system of FIG. 7 according to an embodiment of the invention;

FIG. 10 is a schematic view of a printing station of the printing apparatus of FIG. 9 according to an embodiment of the invention;

FIG. 11 is an enlarged schematic view of the ink-jet printer of FIG. 9 according to an embodiment of the invention;

FIG. 12 is an elevational view of a laser-etched substrate with different sections etched at different values of energy density per unit time;

FIG. 13 is an elevational view of a laser-etched substrate with different sections etched at different values of energy density per unit time and a base coat applied; and FIG. 14 is an elevational view of a laser-etched substrate with different sections etched at different values of energy density per unit time with a base coat and an ink-jet printed design applied.

DETAILED DESCRIPTION OF EXEMPLARY EMBODIMENTS AND EXEMPLARY METHODS

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

In one exemplary embodiment of surface-marked articles and related methods, a method is provided in which a first graphic design element is laser marked on a surface of an article and a second graphic design element is ink-jet printed on the surface of the article. The first graphic design element is registered with the second graphic design element so that the overall graphic design may be a cooperative interaction between the laser-marked graphic design element and the ink-jet printed graphic design element. By orienting the laser-marked first graphic design element and the printed second graphic design element in a predetermined orientation or association relative to each other, methods of the invention may produce a coordinated appearance of the final graphic design. Spatially, the predetermined orientation or association relative to the first and second graphic design elements may involve their registration, superimposition or juxtaposition on the article surface using, for example, predetermined coordinates. Aesthetically, the laser-marked and ink-jet printed graphic design elements produce a synergistic effect manifested as a high quality simulation of natural materials that could not be attained by either laser marking or ink-jet printing alone. In certain exemplary embodiments the laser-marked first graphic design element and the printed second graphic design element may also produce a textural contrast as discussed below.

Figure 1:
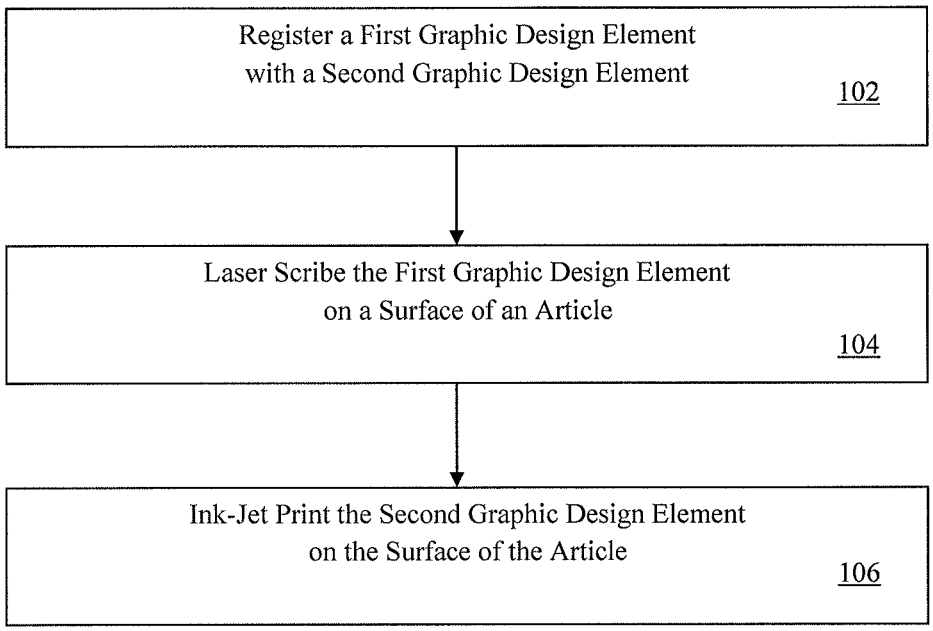
FIG. 1 is a flowchart of a method for marking a surface of an article according to an embodiment of the invention.

Referring now to the drawings, in which like numerals indicate like elements through the several figures, FIG. 1 is a flowchart of a method for marking a surface of an article according to an embodiment of the invention. Articles that may be subject to marking according to the present invention include synthetic building components intended to replicate natural wood. Especially contemplated are exterior entry doors and interior passage doors, decks and deck components, siding, paneling, furniture components, etc., whether of solid construction or so-called hollow core doors constructed from a peripheral door frame with opposite door skins. Peripheral door frames include stiles and rails which define the sides and top and bottom of the door. A pair of door skins have interior surfaces secured to opposite sides of the peripheral door frame via bonding, mechanical fasteners, etc., and opposite exterior surfaces. As known in the art, hollow core doors may include additional support members and/or core materials (e.g., foam) disposed between the skins.

Other building components that may be subject to the exemplary methods and systems described herein include furniture and cabinet doors, closet and bifold doors, door trim, window frames, furniture elements, cabinetry, picture frames, tables, molded wall paneling, wainscot, decking, wall panels, siding, railings, window trim, architectural trim, flooring, etc. For explanatory purposes, exemplary embodiments below are described in relation to building components, in particular door structures. It should be understood that the methods and systems described herein may be used for marking other building component and articles other than building components.

The exemplary embodiments and methods described herein may be used with a variety of substrates, including engineered composite materials such as medium density fiberboard (MDF) and high density hardboard. Engineered composite materials generally contain cellulosic fibers or other particles, often broken down in a defibrillator, and a resin and optionally wax, which are compressed at high temperatures and pressures. The cellulosic fibers/particles often constitute more than 90 weight percent of the material. The cellulosic component typically but not necessarily is wood fiber or wood flour. The binding resin is typically a thermoset. An example of an engineered composite material is disclosed in U.S. Pat. No. 5,344,484. Examples of other materials that may be treated using the systems and methods embodied herein include fiberglass-reinforced sheet molding compound (SMC) polyesters and natural materials, e.g. wood. The substrates may be bare or covered with paints, basecoats, polymer sheets, veneers, and papers.

As shown in FIG. 1, a first graphic design element is registered with a second graphic design element in a first step 102. In one embodiment, the first graphic design element may be associated with a first graphic design element file, and the second graphic design element may be associated with a second graphic design element file. To achieve the desired predetermined orientation or association between the first graphic design element and the second graphic design element, the first graphic design element file and the second graphic design element file may be systematically matched for visual impression (i.e., aesthetics) and tactile impression (i.e., touch) to produce one or more unified graphic design files. Matching the first graphic design element and the second graphic design element may be performed manually or automatically through software utilizing algorithms to identify, match, and/or modify the graphic design elements.

Graphic designs referred to herein may encompass informational (e.g., alpha numeric characters), decorative, and artistic designs. The graphic designs may comprise simple geometric shapes and/or highly complex artistic representations. The graphic design may include repeating patterns such as a diamond, houndstooth or chevron pattern, or non-repeating patterns, such as floral designs. Graphic designs which simulate the appearance of wood grain patterns and routed or mill-worked features are especially applicable. Various exemplary embodiments permit the printing and marking of graphic designs to allow the manufacture of premium products in an economical manner for high output industrial production.

After the first graphic design element is registered, that is, manually or automatically assigned a predetermined orientation or association with the second graphic design element 102, the first graphic design element is laser-marked on a surface of an article in step 104 of FIG. 1. A laser marking printer or laser scriber, comprising a laser and a laser controller may laser-mark one or more graphic design elements onto one or more portions of the surface of the article. Each graphic design element may be associated with a graphic design element file.

In the course of laser marking, a laser beam causes a visually perceptible change to the article surface by causing removal, ablation, or etching of a coated or uncoated article surface. The visually perceptible change may be in the form of a recess of a depth that extends partly through the article or article coating, without cutting entirely through the article. (This is not to exempt the use of the laser for separate cutting operations as well.) The recess may be configured as a channel, groove or trench, cavity, or other depression. Recesses configured as channels/trenches of elongate length may be arranged on the surface of the article to create an appearance that the article (e.g., door structure) has been routed, mill-worked, or assembled together from multiple elements, as opposed to a monolithic structure.

The laser beam can be configured to create textural simulations that mimic the touch or feel of natural materials. For example, the laser beam may be controlled to impart to the recessed area a relatively rough textural feel that closely mimics the texture or feel of a non-synthetic processed object such as routed or millwork wood which has not been significantly sanded. If the planar surface of the article is relatively smooth prior to laser-marking, this smoothness is maintained at areas of the article surface that are not laser-marked, whereas those surface areas that are laser-marked develop a greater coarseness due to the laser marking. The surface topography of the coarse areas may be characterized visually (from a naked eye perspective) as irregular and uneven in many cases. The laser marking, particularly when applied to MDF, forms a surface that appears to expose the ends of individual wood fibers. The contrast in texture between adjacent surface areas contributes to the highly desirable visual impression of the graphic design and adds to the overall aesthetic quality of the product.

The laser marking may be done to the substrate of the article, or to any layer of an applied finish. The laser marking may partially or completely penetrate any one of the layers or the substrate. The depth of the laser marking may vary from a shallow marking on the surface to a complete penetration of the article substrate. In one embodiment, the laser marking may penetrate into the ground coat, but not so far as to penetrate the substrate. In another embodiment, the laser marking penetrates the topcoat but not into the base coat. In other embodiments, the laser marking may penetrate to a combination of these and other depths.

In step 106, the second graphic design element is ink-jet printed on the surface of the article. An ink-jet printer, comprising one or more ink-jet print heads and an ink-jet printer controller, may ink-jet print the second graphic design element onto one or more portions of the surface of the article.

In one exemplary embodiment, during the course of laser marking an MDF article, the resin and wood fibers of the MDF are ablated. The ablation creates a depth, and simultaneously changes the color of the MDF, for example, to a brown tone. When the ablated area is ink-jet printed, the combination of the laser marking and ink-jet printing achieves a synergistic effect with a superior visual appearance to using either technique alone. Furthermore, the areas which are laser marked and printed with ink reflect light differently than the areas which are ink coated but non-laser marked. This contrast adds to the perceived depth of the laser marked areas. The ink may be applied to laser-marked, exposed fibers of the MDF, which provide an enhanced visual and tactile effect previously unobtainable.

The laser marking and ink-jet printing process is not limited by substrate, and may include MDF/hardboard, SMC fiberglass polyesters, papers, polymer sheets, veneers, and natural woods. The substrates may be coated or uncoated with paint or other surface layers.

Figure 2:
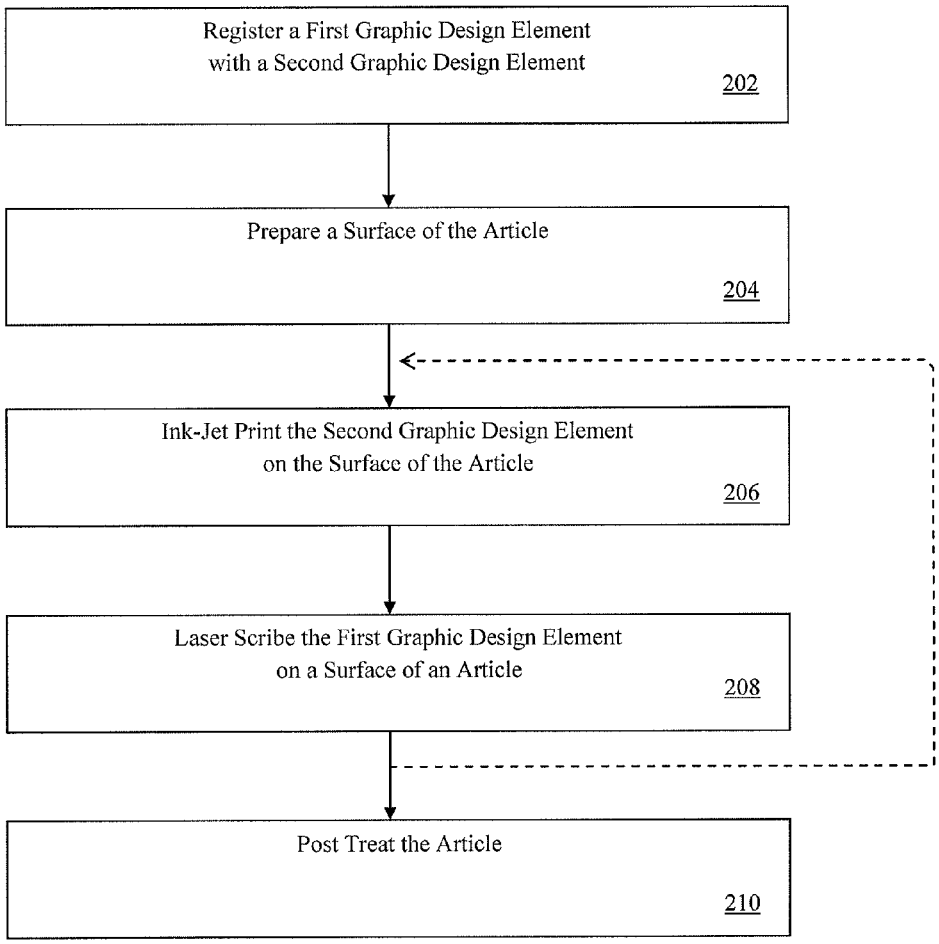
FIG. 2 is a flowchart of a method for marking a surface of an article according to another embodiment of the invention.

In various embodiments, laser marking and ink-jet printing may be conducted in any order or substantially simultaneously. In the embodiment depicted in FIG. 1, a portion of the surface of the article is laser marked first and then ink-jet printed second. FIG. 2 is a flowchart of a method for marking a surface of an article according to another embodiment of the invention. As shown in FIG. 2, the second graphic design element is ink-jet printed on the surface of the article in step 206 before the first graphic design element is laser marked on the surface of the article 208.

As represented by the dashed lines in FIG. 2, the laser marking and ink-jet printing of the graphic design elements may be conducted in multiple stages. (The descriptors "first" and "second" graphic designs are not intended to indicate the sequence in which the graphic designs are created or applied to the article surface.) The entire surface of the article, or alternatively some portion of the surface, may be laser marked. Likewise, the entire surface of the article, or some portion of the surface of the article, may receive ink-jet printing. In some embodiments, it may be beneficial for the laser-marking process to precede ink-jet printing, such as where all or part of the second graphic design element is to be ink-jet printed over some or all of the laser marked first graphic design element.

As shown in the FIG. 2, after the first graphic design element is registered with the second graphic design element in 202, the surface of the article is prepared in step 204. In one embodiment, a base coating is applied to all or part of the surface of the article in step 204. The base coating, for example, readies the surface of the article for ink-jet printing. The base coat may be a layer having a pigment to impart a color feature to the article.

Figure 3:
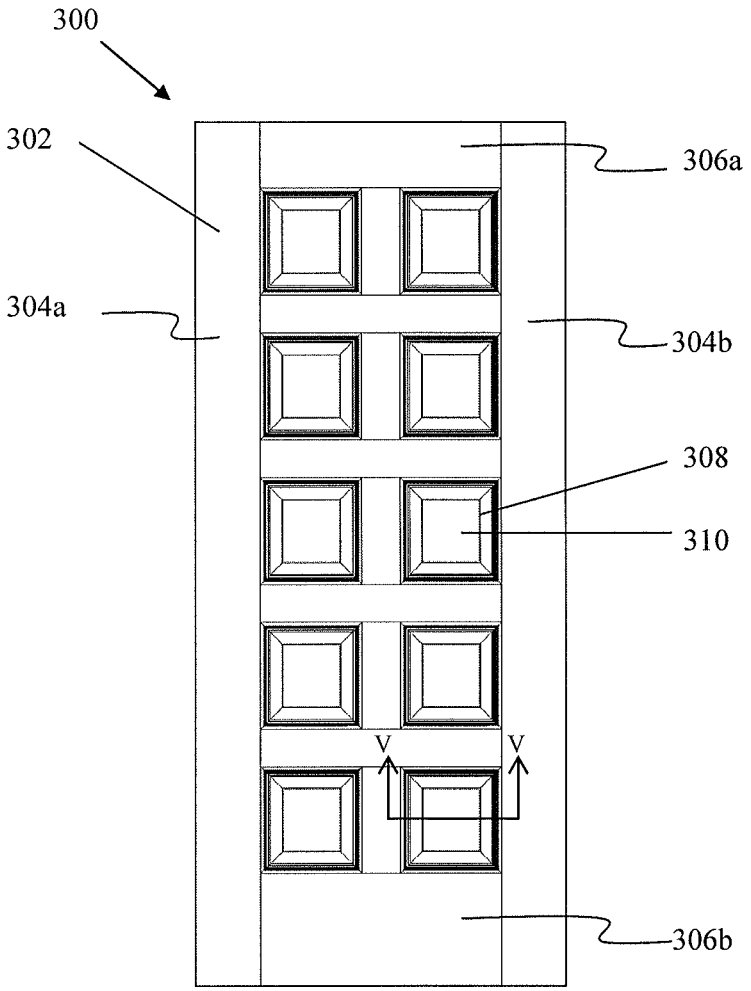
FIG. 3 is an elevational, front view of a door structure article according to an embodiment of the invention.

FIG. 3 is an elevational view where the exemplary article is a door 300 according to an embodiment of the invention. As shown in FIG. 3, a plurality of channels 308 provide the appearance that the door 300 is constructed from a plurality of vertical planks 304*a*, 304*b* and a plurality of horizontal planks 306*a*, 306*b*. The vertical planks 304 and the horizontal planks 306 collectively define a major planar portion 302.

As illustrated in FIG. 3, the channels 308 also are configured in rectangular or square (viewed in plan) orientation to define the outlines of a plurality of interior panels 310. For the purposes of discussion herein, the complete exterior article surface area surrounding or otherwise peripheral to the interior panels 310 is referred to as the major planar portion 302. The exterior surfaces of the major planar portion 302 and the interior panels 310 may be coplanar with one another. The major planar portion 302 and interior panels 310 may possess smooth exterior surfaces, whereas the areas corresponding to the channels 308 may possess a coarser exterior surface to replicate the texture of routed or millwork wood. The door structure 300 of FIG. 3 includes ten (10) of the interior panels 310. The ten interior panels 310 of the illustrated embodiment are square and identical to one another. In other embodiments a surface article may comprise one or more interior panels 310. Further, the interior panels 310 may possess other shapes, and may be identical or different in shape from one another.

Figure 4:
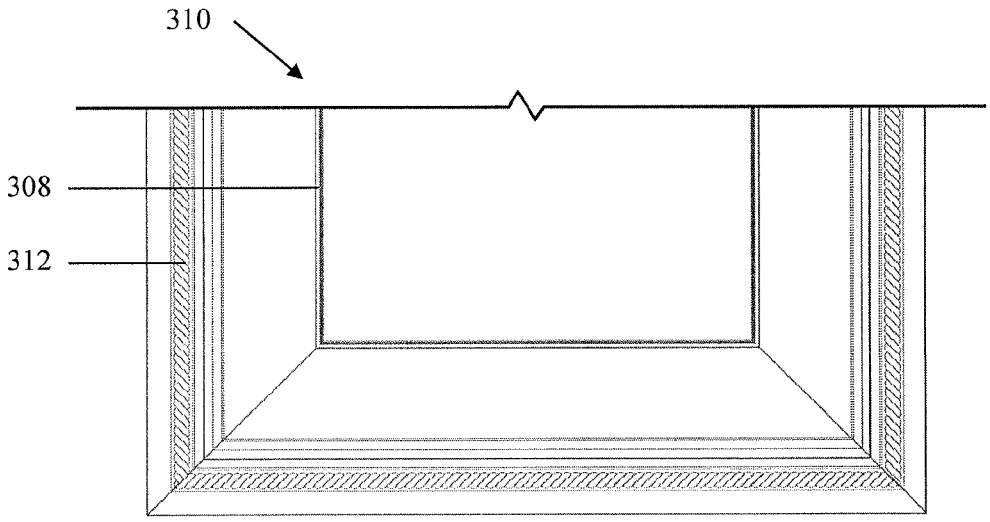
FIG. 4 is an enlarged fragmented view of the door structure article of FIG. 3 according to an embodiment of the invention.

FIG. 4 is an enlarged fragmented view of the door structure article of FIG. 3. As shown in FIG. 4, the channels 308 may be laser etched in close proximity and generally uniformly spaced with respect to one another to provide the peripheries of the interior panels 310 with the appearance of wood that has been expertly routed or subject to millwork. In addition to the laser marking of channels as described above, a variety of other graphics, including intricate and ornate design patterns may be laser marked in various articles such as building products. As one example, the interior panel 308 of door structure 300 includes a highly complex or ornate design such as a twisted-rope design 312 laser etched between the generally uniformly spaced channels 308. It should be understood that other complex designs may be laser marked onto the surface of the article. For example, for wood simulations, small depressions in the article surface may be created through laser marking. These small depressions may mimic the look and feel of wood ticks found in natural wood, such as the ticks of oak or mahogany.

Laser marking may be used to create patterns other than wood or millwork patterns. For example, the recesses laser marked in an article surface may be arranged in a grid pattern to simulate the edges of ceramic tiles or bricks of a wall or floor structure, with the grid pattern of channels having a rough laser marked surface that replicates the appearance of grout or mortar. The texture created by the laser in such channels may be controlled to provide a visual and tactile impression of coarseness similar to that of mortar or grout, whereas non-laser marked areas of the product surface remain smooth to closely simulate the appearance and feel of a ceramic or porcelain. In yet another exemplary embodiment, the recesses may be laser marked along non-linear paths to simulate the edges of natural uncut stone.

A complementary second graphic design element is ink-jet printed in registry with the laser marked first graphic design element so as to create an enhanced or synergistic overall graphic effect. Distinct graphics may be applied to the laser marked areas and non-laser marked areas to increase contrast. In the case of a wood simulation, for example, lighter tones and more visible grain patterns may be ink-jet printed on the smooth (i.e. non-laser marked) areas of the article surface than on the coarse (i.e., laser marked) areas.

The intricate detail of complex designs that might be cost prohibitive or unfeasible to laser mark can be ink-jet printed on the article surface as a second graphic design element registered with a laser marked first graphic design element. Wood grain patterns and wood tones of oak, walnut, cedar, mahogany, and other wood species, can be ink-jet printed on the article surface to replicate real wood-simulated surface appearances. Even exotic wood grain patterns such as leopard wood grain patterns and other patterns can be ink-jet printed. Some patterns which may be capable of laser marking, such as the twisted rope design 312, may be ink-jet printed to speed production.

Figure 5:
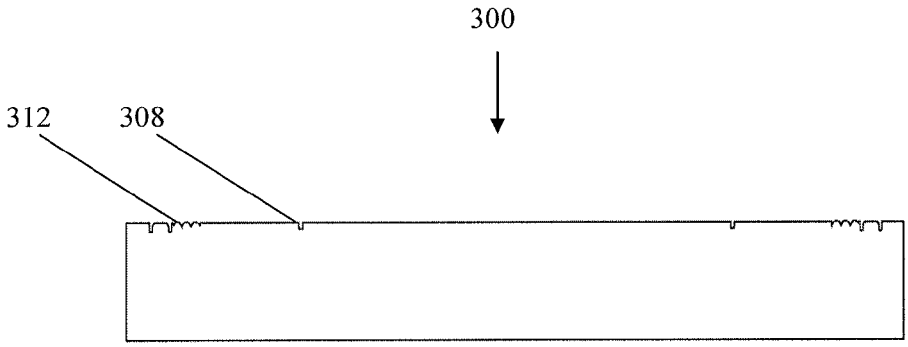
FIG. 5 is a cross-sectional view taken along sectional line V-V of FIG. 3.

The enhanced overall graphic design effect achieves one of three-dimensionality. FIG. 5 is a cross-sectional view taken along sectional line V-V of FIG. 3. In some cases, due to manufacturing and/or economic constraints, sometimes the recesses formed in an article surface via laser marking are relatively shallow and lack substantial depth. Such shallow recesses alone do not necessarily create a realistic impression of three-dimensionality typically achieved by routing and millwork. It is apparent in many instances that the laser-marked article is a monolithic artificial body with no more than surface markings. To confer greater dimensionality and realism to the laser-marked first graphic design element, a second graphic design element is ink-jet printed in registry with the laser-marked first graphic design element on the article surface. In some embodiments, certain ink-jet printers may be configured to apply graphic design elements in the laser-marked recesses.

In a particular exemplary embodiment, one or more ink-jet printed graphic design elements are designed to create an enhanced three-dimensional impression, for example shading, to foster an illusion (or user perception) that the laser-marked first graphic design element has an enhanced depth greater than its actual depth. The ink-jet printed graphic design elements may simulate shading or lighting for this purpose. To create this three-dimensional effect, the ink-jet printed graphic design elements may be applied within the confines of the channel 308 or immediately adjacent to the channel 308, that is, on the edge of the exterior surface of the major planar portion 302 and the interior panels 310.

Advantageously, methods for surface marking articles with registered graphic design elements may produce articles with highly ornate, realistic appearances closely replicating the appearance of more expensive materials such as wood, stone, and ceramic. By using such methods, the high costs of specific alternatives such as unique mold tooling and routing to impart a three-dimension appearance to the article become unnecessary.

FIG. 6 is a flowchart of a method for marking a surface of an article according to another embodiment of the invention. The method of FIG. 6 illustrates one method of using exemplary software for creating a graphic design and converting the graphic design into computer readable media for a laser marker and an ink-jet printer. As shown in FIG. 6, the graphic design is created using Adobe® Illustrator, a vector-based rendering program 602. In various embodiments different vector-based rendering programs can be used to create the graphic design. Alternatively, the graphic design can be received from an optical scanner or optical reader.

Different elements of the graphic design can be manually or automatically selected for lasing and printing, respectively. Such elements may comprise specific features of the graphic design, such as channels or recesses, colors or tones, or specific sections of the graphic design. In one embodiment, a software program automatically identifies features best suited for laser-marking, ink-jet printing, or both, based on predetermined criteria. The software program may utilize an algorithm to automatically select laser marking or ink-jet printing based on image recognition of the graphic design elements or through dimensional information stored in the computer readable media file. In another embodiment, an operator manually identifies or assigns various elements of the graphic design for laser marking or ink-jet printing. Features and/or sections of the graphic design designated for laser marking are referred to herein as first graphic design elements, whereas features and/or sections of the graphic design designated for printing are referred to herein as second graphic design elements. The first and second graphic design elements may be stored together in one unified file or separately in respective files, for example an image file.

The graphic design is divided into a laser graphic template shown in FIG. 6*a* and an ink-jet graphic template shown in FIG. 6*b*. The laser graphic template includes those features of the graphic design that will be processed using vector and raster based programs. Generally, the graphic design elements that are laser marked include lines and curves that define the outlines of the graphic and its major linear and curved features. One or more vector-based rendering programs may create vector files with such features. Other graphic design elements which may be laser marked include three-dimensional "fill" features such as gradient contours and surface textures. Raster-based rendering programs may create one or more raster files with such features. As shown in FIG. 6*a*, the vector-based rendering program AutoCAD® developed by AutoDesk, Inc. creates a vector file 604. The vector-based program Cutting Shop of Arbor Image Corp. also creates a vector file with features such as special contoured fills 606. Such contoured fills may be difficult or impossible to prepare with AutoCAD®. These programs are capable of converting digital graphic images or patterns into a DXF type vector file.

In other embodiments, other vector-based programs may be used to create laser markable graphic design elements. For example, various exemplary embodiments include software developed to generate random ticks or depressions in the laser-marked engineered wood substrates that after ink jet printing achieve a very realistic wood appearance. A user utilizing the software may select a predetermine type, size, and shape of tick. Different ticks may be presented to the user as being associated with different types of wood. The user may also select the number and placement of the ticks. The location of the ticks also may be randomly or automatically generated by the software depending on the type of wood and size of the substrate to correspond with the natural wood. Various wood surfaces, such as oak, walnut, mahogany, cedar, cherry, maple, and others, may be replicated by the combined laser etching and ink jet printing concept. Even exotic wood surfaces such as tiger wood or unusual woods from the rain forest can be replicated by the combined laser etching and ink jet printing. The software may also allow the user to select different colors which control the depth of the laser etching in specific areas.

Referring still to FIG. 6*a*, Adobe Photoshop® may be used to create a raster file containing a gray-scale image of three-dimensional "fill" features such as gradient contours and surface texture. From the gray-scale image, the raster-based program Technoblast® of Technolines LLC creates computer readable instructions for controlling the laser path and power for laser marking the "fill" features 608.

After various vector files are created, the files may be "ripped," or converted to a form which is understandable by a laser marker or an ink-jet printer. The raster- and vector-based program Exodus may be used to rip the files received from the AutoCAD®, Cutting Shop, or Technoblast® programs 612. The Exodus program rips the files into both a .dxf graphic (vector) file 616 and a .tbf graphic (raster) file 618 which can be utilized by the laser marker and ink-jet printer equipped with appropriate software to convert computer files into the laser and printer manufacturer's language.

The ink-jet graphic template may represent both the coloring of the graphic design and any fill patterns that are not appropriate for vector-based processing. As shown in FIG. 6*b*, the raster-based rendering program Adobe Photoshop® may be used to create a raster file containing coloring (e.g., tone, shading, background color) and printing information 610. As with the laser-marking shown in FIG. 6*a*, vector based graphics from Adobe Illustrator may also be used. Next, the raster and/or vector file is ripped to the ink-jet printer 614. As shown in FIG. 6*b*, a software program, such as the Wasatch SoftRIP Version 5.1.2 of Wasatch Computer Technologies, Inc., rips the files to an ink-jet printer controller compatible format.

After the laser graphic template and the ink-jet graphic templates have been ripped into the appropriate formats, the graphic design elements are laser-marked 104 and ink-jet printed 106 onto the surface of the article to produce a surface-marked article 620.

An exemplary system for laser marking and ink-jet printing graphic design on articles such as building components using a high-speed, high-power laser and ink-jet printer is shown in FIGS. 7-11. It should be understood that the elements of the system described below are exemplary and are not necessarily intended to be limiting on the scope of the invention. Other systems and apparatus may be substituted for those described below, and the system and apparatus described below may be modified as dictated by the nature of the graphic design and the article.

FIG. 7 is a schematic view of a system for marking a surface of an article according to an embodiment of the invention. As shown in FIG. 7, the embodied system according to one embodiment of the invention includes a workstation computer 702, a laser controller 704, a laser 706, a laser scanner 710, an ink-jet printer controller 712, and an ink-jet printer apparatus 714.

The workstation computer 702 can be configured to receive a graphic design to be applied to the work piece or article. As shown in FIG. 7, the work piece comprises the door structure 300, which comprises a working surface 718. The workstation computer 702 is in operative communication with a laser controller 704 and a printer controller 712. The laser controller 704 communicates with a laser 706 and a laser scanner 710 for directing the path of a laser beam 708. The ink-jet printer controller 712 communicates with an ink-jet printing apparatus 714, discussed in greater detail below.

The workstation computer 702 may be, for example, a personal computer system. Computer hardware and software for carrying out the embodiments of the invention described herein may be any kind, e.g., either general purpose, or some specific purpose such as a workstation. The workstation computer 702 may be any class of computer, running any operating system, such as Windows XP®, Windows Vista, Windows 7®, or Linux®. Alternatively, the workstation computer 702 may be a Macintosh® computer, tablet, or mobile device such as a smart phone.

The controller 704 affects the speed of laser power change. For example, a graphic image with 32 lines per inch requiring the laser power to change every 2 pixels can achieve a maximum laser span speed of 15 m/s at a controller speed of 10,000 pixels per second. In order to double the laser speed to 30 m/s in this instance, the controller 704 should have a processing power of 20,000 pixels per second. As the laser lines per inch increase, the controller speed becomes more important for maintaining high laser line speed. In various exemplary embodiments, the controller 704 will have speeds between about 10,000 pixels per second and about 50,000 pixels per second.

The computer program loaded on the workstation computer 702 may be written in C, C++, C#, Java, Brew or any other suitable programming language. The program may be resident on a storage medium, e.g., magnetic or optical, of e.g., the computer hard drive, a removable disk or media such as a memory stick or SD media, or other removable medium. The programs may also be run over a network, for example, with a server or other machine sending signals to one or more local machines, which allows the local machine(s) to carry out the operations described herein. Computer aided design (CAD) software can be employed.

In the embodiment illustrated in FIG. 7, the laser 706 generates a laser beam 708 which is passed through the laser scanner 710. The laser controller 704 may control the operating parameters of the laser 706 as well as the laser scanner 710 to direct the path of laser beam 708 across the surface of the door 300. The laser scanner 710 directs the path of the laser beam 708 using relatively light weight coated mirrors (discussed below). The laser controller 704 is capable of controlling the movement of the lightweight mirrors of the laser scanner 710 and simultaneously adjusting power to the laser 706 to direct laser beam output 708*a* along a path that marks the first graphic image element on the door 300.

The laser scanner 710 and ink-jet printing apparatus 714 are in close proximity to a working platform or bed 716 that supports the door 300, which in the illustrated embodiment is a door structure in a pre-fabricated state. The door 300 may alternatively be a door skin or door facing. In FIG. 7, the laser scanner 710 is "upstream" of the ink-jet printer apparatus 714. In other embodiments, the ink-jet printer apparatus may be upstream of the laser scanner 710. Additionally, various embodiments may comprise multiple lasers 706 and/or multiple ink-jet printer apparatus 714.

The working platform 716 may be movable to carry the door 300 or alternatively the door may be moveable relative to the working platform 716. In either case the door 300 is moved relative to the directed laser beam 708*a* and the ink-jet print head (not shown in FIG. 7) of the printing apparatus 714 to create the desired graphic design. As used herein, relative movement may comprise movement of the directed laser beam 708*a* and/or movement of an ink-jet print head of the ink-jet printer apparatus 714 in proximity to the door 300 and/or working platform 716 while the bed 716 and/or door 300 remain stationary. Relative moment may further comprise movement of the working platform 716 and/or door 300 while the directed laser beam 708*a* and the ink-jet print head of the ink-jet printing apparatus 714 remain stationary. Additionally, relative movement may comprise combined movement of the directed laser beam 708*a*, ink-jet print head of the ink-jet printer apparatus 714, bed 716 and/or door 300.

FIG. 8 is a schematic view of a laser controller and laser of the system of FIG. 7 according to an embodiment of the invention. The system shown in FIG. 8 comprises the workstation computer 702, which is in communication with the laser controller 704. The laser controller 704 is in communication with the laser 706, an x-axis galvanometer 802, a y-axis galvanometer 806, and a tank 812.

The laser scanner 710 comprises a computer-controlled mirror system. The illustrated mirror system includes an x-axis mirror 804 rotatably mounted on and driven by an x-axis galvanometer 802. The x-axis galvanometer 802 is adapted to rotate and cause the rotation of the x-axis mirror 804. Rotation of the x-axis mirror 804 while the laser beam 708 is incident on the mirror 804 causes the laser beam 708 incident on mirror 808 to move along the x-axis. The laser controller 704 may be configured to control rotation of the x-axis mirror 804 by the x-axis galvanometer 802 by regulating the power supplied to the x-axis galvanometer 802.

The laser beam 708 is deflected by the x-axis minor 804 and directed toward a y-axis mirror 808 rotatably mounted on y-axis galvanometer 806. The y-axis galvanometer 806 is adapted to rotate and cause rotation of the y-axis mirror 808. Rotation of the y-axis mirror 808 causes movement of the laser beam 708 along the y-axis. The laser controller 704 may also be configured to control rotation of the y-axis mirror by the y-axis galvanometer by regulating of the power supplied to the y-axis galvanometer 806.

The operating parameters of the laser 708*a*, for example speed and power, are regulated to produce high resolution graphic elements with the laser marker. For example, the laser controller 704 may rotate the x-axis galvanometer 802 and the y-axis galvanometer 806 at high rates to increase the speed of the directed laser beam 708*a* across the surface of the door 300. The speed of the directed laser beam 708*a* may determine the appropriate power level for the laser as the graphic is laser marked. Certain characteristics of the graphic design, such as the complexity, intricacy, and depth of the design may influence how the graphic design is laser marked onto the door structure 300.

The laser beam 708 is deflected by the y-axis mirror 808 and directed through a focusing apparatus 810 adapted to focus the laser beam 708 into a directed laser beam 708*a*. The focusing apparatus 810 may comprise a multi-element flat-field focusing lens assembly, which optically maintains the focused spot (i.e. focal point) on a flat plane as the directed laser beam 708*a* moves across the door 300 to laser mark a graphic design element such as a channel 308. Although not shown, the lens 810, mirrors 804, 808 and galvanometers 802, 806 can be housed in a galvanometer block or scan head. Various exemplary embodiments utilize a post objective scanning architecture to process large fields, for example, those needed to laser etch doors. Post-objective scanning architecture utilizes the two-dimensional x-y scanning mechanisms, such as mirrors 804, 808 and galvanometers 802, 806 placed after the lens 810 which may be a focal or objective lens.

The working platform 716 can be a solid substrate or even a fluidized bed. The door 300 is placed on the working platform 716. The door 300 comprises a viewable, laser markable and ink-jet printable working surface 718, which in an exemplary embodiment corresponds to the exterior surface of a door skin. The working platform 716 can be adjusted vertically to adjust the distance from the lens 810 to the working surface 718. The laser beam 708 is directed by the mirrors 804, 808 to cause the directed laser beam 708*a* to be incident on the surface of the door 300.

The directed laser beam 708*a* is typically directed along a path generally perpendicular to the laser-markable working surface 718, but different graphics can be achieved by adjusting the angle between the directed laser beam 708*a* and the laser-markable working surface 718, for example, from about 45° to about 135° relative to the working surface 718. Relative movement between the directed laser beam 708*a* incident on the laser-markable working surface 718 causes a graphic such as channel 12 to be laser marked on the laser-markable working surface 718. As referred to herein, relative movement may involve movement of the directed laser beam 708*a* (e.g., using the mirror system) as the door 300 remains stationary, movement of the door structure 300 while laser directed laser beam 708*a* remains stationary, or a combination of simultaneous movement of the directed laser beam 708*a* and the door 300 in different directions and/or at different speeds.

According to an exemplary implementation, a graphic design is scanned or otherwise input into the workstation computer 702 and converted into the proper format. Information corresponding to the laser marked features of the graphic design are communicated to the laser controller 704 with instructions to laser mark the graphic design elements on corresponding sections. The laser controller 704 subsequently controls movement of the galvanometers 802, 806 and the operating parameters of the laser 706 to laser mark the first graphic design element on the working surface 718 of the door 300, for example at the appropriate power and movement velocity for high throughput. The laser beam power, laser beam size, and laser beam speeds may be controlled to avoid any undesirable consequences of over-treatment, such as complete carbonization, burn-through and/or melting of the door 300. The system can also include a tank 812 to inject a gas such as an inert gas into the work area. The amount of gas may be controlled automatically by the workstation computer 702, laser controller 704, or some other apparatus.

In one exemplary embodiment, a 2,000 watt laser is coupled to an ultra high speed laser scanner 710 capable of moving the laser beam 708*a* across the printable working surface 718 in excess of 30 meters per second. In other embodiments, lasers with other power measurements, up to and above 2,500 watts, and laser scanners with different scan speeds, up to and above 65 meters per second, are utilized. Laser scan speeds of 30-50 meters per second can mark graphic designs in time frames measured in seconds per square foot and unit costs measured in pennies per square foot. As referred to herein, "speed" is the speed of the directed laser beam 708*a* relative to the working surface 718. Relative speed may be controlled by moving the directed laser beam 708*a* while maintaining the working surface 718 in a stationary position, by moving the working surface 718 while maintaining the directed laser beam 708*a* in a stationary position, or by simultaneously moving the directed laser beam 708*a* and the working surface 718 in different directions and/or at different rates.

According to an exemplary embodiment, a high-speed high-power laser is used to form the first graphic design element on the surface of the door structure 300. The laser 706 may be a high power $CO_2$ laser having an output power of 500 W, 1000 W (1 kW), 2000 W (2 kW), 2500 W (2.5 kW), or greater. The laser power output referred to herein is continuous, as distinguished from the power output when a laser has a temporary energy surge, or when the laser is pulsed. The continuous power can be varied by adjusting the power setting on the laser 706. The frequency of the laser beam 708 is typically in the range of for example, 10 to 60 kHz. An exemplary commercial laser, such as a 2.5 kW $CO_2$ laser, model number DC025, is available from Rofin-Sinar Technologies, Inc.

In order to provide a laser system with 1,000-2,500 watts that is galvanometer-driven at high scan speeds, e.g., ranging from 30-50 meters/second, commercially available lightweight mirror systems with high temperature coatings are particularly useful. One such commercially available lightweight mirror system is the ScanLab AG, Model PowerSCAN33 Be, 3-axis Galvanometer scanner with 33 mm Be Mirrors. The high temperature coating is believed to be a physical vapor deposited alloy. The lightweight beryllium substrate is coated with materials allowing the mirror surface to reflect over 98% of the $CO_2$ wavelength, 10.6 microns. Lightweight mirror systems allow the galvanometers to move the directed laser beam 708*a* in a repeatable but efficient fashion over the printable working surface 718. The scan speed of such a laser system may be an order of magnitude higher than the laser scan speeds achieved with either linear drives or conventional galvanometer mirrors. Using such a lightweight mirror system, laser scan speeds in excess of 65 meters per second can be achieved compared to maximum scan speeds of 4-5 meters per second with conventional laser engraving technology.

In one example, a system for laser etching plastic lumber in a continuous process for mass production may comprise a 2,500 watt laser operating at high speeds and directed at a working surface of 50.8 cm (20 inches) to match the line speed of the process. However, in order to properly laser mark 3 foot by 8 foot interior doors for mass production, it may be more efficient to employ multiple lasers or a linear motor to cover the entire working surface. Regardless of the arrangement, laser powers of 500 watts and higher (e.g., from 500-2,500 watts) and laser scan speeds of 10 meters per second and higher (e.g., from 10-50 meters per second) produce satisfactory economics in unit costs for lazing graphics on building products. Reductions in the actual unit costs could be reduced an order of magnitude, from dollars-per-square-foot to cents-per-square-foot.

The type, quality, and depth of a laser etched image may be controlled by modifying the operating parameters of the laser 10 to adjust the energy density per unit of time (EDPUT) applied to the working surface 718. EDPUT is a parameter that defines the amount of power that is applied to a certain area in any unit time. The EDPUT may be expressed in watts-sec/$mm^3$ or other analogous units which express continuous laser power (watts) divided by the speed of movement of the laser times the area of the laser spot ($mm^3$/s). The EDPUT can be controlled by control of laser power, laser beam spot size, duty cycle, or speed of the laser relative to the work piece for a given power, or by other parameters, and a combination of parameters. For further explanation of EDPUT, see U.S. Pat. No. 5,990,444, the disclosure of which is incorporated herein by reference.

By controlling the EDPUT, different features may be repeatedly laser etched into a substrate utilizing different laser powers and scan speeds in accordance with different operational requirements. The EDPUT also may be controlled to prevent undesirable defects while forming a visible image on the substrate. Too little EDPUT will result in a less distinguishable mark from the base substrate, whereas too much EDPUT may generate undesirable defects such as undesirable holes, burning, charring, or undesirable change in color. The EDPUT values to create various images change depending on the substrate. Accordingly, the process parameters of EDPUT for laser etching and ink jet printing must be controlled in order to produce aesthetically pleasing surfaces that replicate the look of real products such as wood, tile and others, on different substrates.

Systems and methods for surface marking articles may be carried out using various other laser systems and scanning devices, having modified and alternative layouts and elements to that shown in FIG. 8. Examples of laser systems are disclosed in U.S. Patent Application Publication No. 2007/0108170 to Costin et al. and WO/2008/156620 to Costin et al, the disclosures of which are incorporated by reference.

The ink-jet printing apparatus 714 is configured to ink-jet print graphic designs on a work piece such as the door 300. The door 300, which comprises a printable working surface 718, is supported on the working platform 716, which may be the same working platform or different working platform used to support the door 300 during laser marking. Preferably the working platform 716 is capable of supporting multiple objects and moving the objects relative to the ink-jet printing apparatus 714 for continuous manufacturing.

FIG. 9 is a schematic view of an ink-jet printing apparatus 714 of the system of FIG. 7 according to an embodiment of the invention. As shown in FIG. 9, the ink jet printing apparatus 714 comprises coating station 902, drying station 904, printing station 906, topcoat station 910, and topcoat curing station 912. A work piece, such as door structure 300, may move on the working platform 716 in a sequential order through the ink-jet printing apparatus 714, moving from the coating station 902 to the drying station 904, the printing station 906, the topcoat station 910, and finishing at the topcoat curing station 912.

The coating station 902 may be configured to spray or otherwise apply a ground coat to the exterior surface of the door 300. Multiple ground coats may be applied to the exterior surface of the door 300, such as a first ground coat on the major planar portion 302 and interior panels 310 and a second ground coat in the channels 308. The second ground coat may provide an appearance of shadowing in the channels 308. A darker tone in the channels 308 can provide a richer appearance. The ground coat(s) may include a colored paint, such as a color simulating a wood tone such as mahogany. The coating station 902 may include a manual spray gun or an automatic robotic sprayer. If a wood grain pattern is to be ink-jet printed or laser marked, the ground coat(s) may contribute to replication of the background tone of the wood grain pattern.

After leaving the coating station 902, the door structure may enter a drying station 904. The drying station 904 may cure or dry the one or more ground coats of the door structure 300. The drying station 904 may include an induction radiation heater for drying the ground coat, or some other pigment drying device.

The door 300 is then forwarded to a printing station 906 and the selected image is ink-jet printed on the exterior face of the door 300. The printing station 906 may comprise a UV-curing lamp 908. In an exemplary embodiment, the ink printed on the exterior surface of the door 300 is UV-curable. One commercially available UV-curable ink is Sericol UviJet curing ink; however other UV-curing inks may be used. The UV-curable ink is then cured by the UV-curing lamp 908.

After leaving the printing station 906, the door 300 may enter the topcoat station 910. The topcoat station 910 may apply a topcoat or protective layer, such as a UV curable coating. The topcoat may be, for example, a clear varnish. The topcoat may be printed, sprayed or otherwise applied to the exterior surface of the door 300. Finally, the topcoat may be dried at a UV topcoat curing station 912 or air-dried with heated air or at room temperature.

FIG. 10 is a simplified view of a printing station of the printing apparatus of FIG. 9 according to an embodiment of the invention. The printing station 906 comprises an ink-jet printer 1002 which includes at least one ink-jet print head 1004. The ink-jet print head 1004 is in communication with the ink-jet printer controller 712. The ink-jet print head 1004 is mounted for movement in a direction perpendicular to the direction of movement of the door structure 300. Arrow 1006 shows the direction of movement of the ink-jet print head 1004, and arrow 1008 shows the direction of movement of the working platform 716. The ink-jet print head 1004 is preferably movable along direction 1006 across the entire width of the door structure 300. The printer 1002 may be a flat bed printer, such as available through Inca Digital Printers Limited of Cambridge, United Kingdom. The printer 1002 may also have a print head 1004 that stretches across the entire width of the working platform 716.

FIG. 11 is a simplified view of the ink-jet printer of FIG. 9 according to an embodiment of the invention. As shown in FIG. 11, the printer 1002 includes a rail 1102 for supporting the ink-jet print head 1004. The rail 1102 provides for lateral movement of the ink-jet print head 1004 under the control of the ink-jet print controller 712. The ink-jet print head 1004 is shown with a UV curing lamp 1104 for drying and curing the ink-jet ink. Alternatively, a separate curing station, such as UV-curing lamp 908, as shown in FIG. 9, may be provided. Ink-jet ink droplets 1106 are emitted from nozzles 1108 of the ink-jet print head 1004.

The nozzle outlets of the ink-jet print head 1004 travel in a plane P2 that is separated from plane P of door 300 by a space G. Therefore, the distance traveled by ink droplets 1106 emitted from nozzles 1108 varies depending on whether the ink-jet print head 1004 is over the planar portion (e.g., major planar portion 11 or panels 14) or over one of the channels 308. If the distance is too great, the ink-jet printed images may become blurred, particularly in the channels 308.

The nozzles 1108 have a diameter of up to and above 20 microns. The droplets 1106 will have a diameter approximately equal to the diameter of the nozzles 1108. For example, a Fujifilm Dimatix Spectra SL series, SE series, or Sapphire series ink-jet print head may be used, which creates droplets having a diameter of about 40 microns. The relative speed of the ink-jet print head 1004 and the and the angle of the nozzles 1108 relative to plane P2 (for example, the nozzles 1108 may be tilted) defines the incident angle at which a droplet 84 is emitted from the nozzle 1108 relative to the upper face of the door structure 300.

It should be understood that the ink-jet printer 1002 may include multiple ink-jet print heads 1004 arranged in rows, columns, or arrays, so that each pass may print in more than one set of print grid positions. The nozzles 1108 may emit ink-jet droplets 1106 of various desired colors in order to create a desired color. More description and information concerning the ink-jet printing apparatus 714 can be found in U.S. Pat. No. 7,001,016, the disclosure of which is incorporated herein by reference.

Based on the type of material and the desired image, the EDPUT applied to the working surface 718 by the laser beam 708*a* is adjusted to correspond with the image created by the ink-jet printing apparatus 714. For example, if the EDPUT is too small, the base coat or first layer of droplets from the ink jet printer may fill and conceal the laser depressions such that there would be no depth or dimensionality to the substrate once the ink is applied. Conversely, if the EDPUT is too large, char or residue may be left on the surface which would produce noticeable defects upon the application of a base coat or ink-jet printed image. If the EDPUT is too large, the final appearance of the product also may not be aesthetically pleasing because of too much depth in the laser depressions.

FIG. 12 depicts an MDF substrate having ten sections 1201*a*-1210*a* laser etched with a wood grain pattern at different EDPUT values. The EDPUT decreases from section 1201*a* to section 1210*a*, thus the EDPUT decreases from left to right in the top sections 1201*a*-1205*a* and then again in the bottom sections 1206*a*-1210*a*. In an exemplary embodiment, the EDPUT for the laser etched bottom sections 1206*a*-1210*a* decreases from approximately 0.66 watts-sec/mm$^3$ to approximately 0.13 watts-sec/mm$^3$ and top sections 1201*a*-1205*a* decreases from approximately 1.33 watts-sec/mm$^3$ to approximately 0.80 watts-sec/mm$^3$. While the laser etched wood grain graphic is barely visible in sections 1208*a*-1210*a*, the grain appears quite visible in sections 1206*a* and 1207*a*, corresponding to EDPUT values of approximately 0.55 watts-sec/mm$^3$ and approximately 0.66 watts-sec/mm$^3$, respectively.

FIG. 13 depicts laser etched sections 1201*b*-1210*b* corresponding to the laser etched sections 1201*a*-1210*a* of FIG. 12 with the application of a base coat on top of the laser etched MDF. After the application of the base coat, the laser etched graphic appears distinctly in the top sections 1201*b*-1203*b*, lightly in top sections 1204*b* and 1205*b*, very faintly in bottom sections 1206*b* and 1207*b*, and not at all in bottom sections 1208*b*-1210*b*. In an exemplary embodiment, the EDPUT for top section 1203*b* is approximately 0.93 watts-sec/mm$^3$. Though the grain may be less noticeable in certain sections, different depths and texturing are still distinguishable on the substrate through sight and touch.

FIG. 14 depicts laser etched sections 1201*c*-1210*c* corresponding to the laser etched sections 1201*a*-1210*a* of FIG. 12 with the application of a base coat followed by the application of ink through ink-jet printing. As shown in FIG. 14, the combination of laser etching and ink-jet printing provides the depth and appearance of natural wood grain. The upper left section 1201*c*, etched with an EDPUT value of approximately 1.33 watts-sec/min$^3$ best reveals the depth and dimensionality required to simulate the texture and feel of real wood. Even the sections which did not distinctly appear after the base coat, for example sections 1206*b*-1210*b* depicted in FIG. 13, have the appearance of a natural wood grain pattern with appropriate ridges and grain lines. The exemplary embodiments depicted in FIGS. 12-14 illustrate that the EDPUT required for generating visible graphics on MDF may be quite a bit different than that required for generating the depth and dimensionality with base coat and ink-jet printing. Of course the specific EDPUT values could change significantly for different substrates, different graphics, and different resolutions.

For a given laser spot size, the power and speed may be controlled in such a manner to produce sufficient EDPUT to create a distinguishable laser etched graphic on a substrate at the highest speed to reduce throughput times and increases the economic value of the laser-etching procedure. In various exemplary embodiments the laser parameters are configured to provide the maximum power and, in turn, fastest speed that produces a distinguishable laser mark after subsequent ink-jet printing. The spot size controls the resolution of the laser etching. Finer spot sizes produce finer impressions and better resolution. Table 1 below reveals the EDPUT calculations for a variety of laser speeds and spots sizes for a 2,500 watt laser operating at maximum power.

TABLE 1

| EDPUT Calculations for 2,500 Watt Laser | | | | |
|---|---|---|---|---|
| Speed (mm/sec) | Spot Diameter mm | Area of Spot ($mm^2$) | Power (watts) | EDPUT watts-sec/$mm^3$ |
| 1000 | 0.2 | 0.0314 | 2500 | 79.61783439 |
| 1000 | 0.3 | 0.07065 | 2500 | 35.38570418 |
| 1000 | 0.4 | 0.1256 | 2500 | 19.9044586 |
| 1000 | 0.8 | 0.5024 | 2500 | 4.97611465 |
| 1000 | 1.2 | 1.1304 | 2500 | 2.211606511 |
| 5000 | 0.2 | 0.0314 | 2500 | 15.92356688 |
| 5000 | 0.4 | 0.1256 | 2500 | 3.98089172 |
| 5000 | 0.8 | 0.5024 | 2500 | 0.99522293 |
| 5000 | 1.2 | 1.1304 | 2500 | 0.442321302 |
| 10000 | 0.2 | 0.0314 | 2500 | 7.961783439 |
| 10000 | 0.3 | 0.07065 | 2500 | 3.538570418 |
| 10000 | 0.4 | 0.1256 | 2500 | 1.99044586 |
| 10000 | 0.8 | 0.5024 | 2500 | 0.497611465 |
| 10000 | 1.2 | 1.1304 | 2500 | 0.221160651 |
| 20000 | 0.2 | 0.0314 | 2500 | 3.98089172 |
| 20000 | 0.4 | 0.1256 | 2500 | 0.99522293 |
| 20000 | 0.8 | 0.5024 | 2500 | 0.248805732 |
| 20000 | 1.2 | 1.1304 | 2500 | 0.110580326 |
| 40000 | 0.2 | 0.0314 | 2500 | 1.99044586 |
| 40000 | 0.4 | 0.1256 | 2500 | 0.497611465 |
| 40000 | 0.8 | 0.5024 | 2500 | 0.124402866 |
| 40000 | 1.2 | 1.1304 | 2500 | 0.055290163 |

Laser etching at various EDPUT values may also influence the reflectivity of the surface of the substrate. Gloss is typically a measure of the reflectivity of the surface. A relatively flat non-glossy surface may have a qualitative rating of 7-10, whereas a glossy surface may have a rating of 20-25. The reflectivity or gloss will thus be different for ink-jet printed surfaces with and without laser etching. For example, laser etching may reduce the reflectivity of a surface, so that for higher EDPUT values an etched surface may have less reflectivity. Accordingly, the EDPUT value may be controlled to alter surface reflectivity to achieve a desired surface finish.

In various exemplary embodiments, the laser etching also masks defects, such as graininess or pixilation of the ink-jet printed surface. These defects may be caused by light color tones which have less ink in certain areas of the substrate. The defects may also be the result of limited resolution in the ink-jet printer. The laser etching may be applied to the substrate so that the depth and color modification created by the laser etching blends with the ink-jet printed image to hide any defects. The laser etching can therefore be used to smooth out any lines and ensure the appropriate color contrast.

Another aspect of the invention relates to a system of graphics software, ink jet printing hardware, and laser etching hardware which is used in combination to replicate the look of any surface on a substrate. The software is configured to receive and image file any analyze the colors, textures, and patterns represented therein. A user may modify features of the image file, for example the color, depth, line weight, and size of the image. The file may then be compiled into instructions for a laser and an ink-jet printing apparatus.

The foregoing detailed description of the certain exemplary embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Although only a few embodiments have been disclosed in detail above, other embodiments are possible and the inventors intend these to be encompassed within this specification and the scope of the appended claims. The specification describes specific examples to accomplish a more general goal that may be accomplished in another way. Modifications and equivalents will be apparent to practitioners skilled in this art and are encompassed within the spirit and scope of the appended claims and their appropriate equivalents. This disclosure is intended to be exemplary, and the claims are intended to cover any modification or alternative which might be predictable to a person having ordinary skill in the art. For example, other kinds and wattages of lasers, beyond those described above, could be used with this technique.

Only those claims which use the words "means for" are to be interpreted under 35 USC 112, sixth paragraph. Moreover, no limitations from the specification are to be read into any claims, unless those limitations are expressly included in the claims.

What is claimed is:

1. The method of replicating the look of any surface comprising:

obtaining a digital pattern which defines the look of a surface;

converting the digital pattern to a DXF vector file with a software program;

importing the DXF vector file to a software program which instructs the laser to etch the pattern at specific operating parameters;

laser etching the graphic or pattern on the substrate;

importing the digital pattern to a raster-rendering program;

converting the digital graphic to a raster file using the raster-rendering program;

converting the raster file to the ink jet controller language; and ink jet printing the digital pattern on the laser-etched substrate.

2. A method to create the illusion of graphic patterns that appear deeper in dimension than they actually are comprising:

obtaining a digital graphic file which defines the look of a surface of an article;

altering the digital graphic file to adjust the line placement, density, and shadowing characteristics of the graphic for both laser etching and ink jet printing; and laser etching and ink jet printing the graphic on a substrate.

3. The method of claim 2, wherein software allows a user to select different colors which relate to the depth of the laser etching in a specific area of the graphic.

4. A method for replicating the look of any surface comprising:

analyzing an image to determine colors and tonal characteristics;

separating the image into a first design element to be laser-etched and a second design element to be ink-jet printed based on said analyzing;

laser etching the first design element on a substrate; and ink jet printing the second design element on the substrate.

5. The method of claim 4, wherein the first and second design elements are designed to interact to achieve a realistic replication of any surface with the color, tonal characteristics, depth, and dimensionality of the surface being accurately replicated.

6. The method of claim 5 wherein the graphic elements mimic actual wood looks.

7. A system for performing the method of claim 4 comprising:

software to perform said analyzing and said separating;

a laser system for performing said laser etching; and an ink-jet printing system for forming said ink-jet printing.

8. An article formed by the method of claim 4.

* * * * *